US009079733B2

(12) United States Patent
Wardak et al.

(10) Patent No.: US 9,079,733 B2
(45) Date of Patent: Jul. 14, 2015

(54) VORTEX SUCTION SEPARATOR DEVICE

(75) Inventors: Andreas Wardak, Rottweil (DE); Peter Xavier Kearney, Friding (DE)

(73) Assignee: BDT MEDIA AUTOMATION GMBH, Rottweil (DE)

( * ) Notice: Subject to any disclaimer, the term of this patent is extended or adjusted under 35 U.S.C. 154(b) by 743 days.

(21) Appl. No.: 12/775,522

(22) Filed: May 7, 2010

(65) Prior Publication Data

US 2011/0272877 A1 Nov. 10, 2011

(51) Int. Cl.

| | |
|---|---|
| ***B65H 3/12*** | (2006.01) |
| ***B65H 3/48*** | (2006.01) |
| ***B65H 3/62*** | (2006.01) |
| ***B65H 5/22*** | (2006.01) |
| ***B65H 9/16*** | (2006.01) |
| ***B65H 15/00*** | (2006.01) |

(52) U.S. Cl.

CPC ..... *B65H 3/128* (2013.01); *B65H 3/124* (2013.01); *B65H 3/48* (2013.01); *B65H 3/62* (2013.01); *B65H 5/224* (2013.01); *B65H 9/163* (2013.01); *B65H 15/00* (2013.01); *B65H 2301/33216* (2013.01); *B65H 2406/323* (2013.01); *B65H 2406/3662* (2013.01)

(58) Field of Classification Search

USPC ..... 271/97, 98

See application file for complete search history.

(56) References Cited

U.S. PATENT DOCUMENTS

| | | | | |
|---|---|---|---|---|
| 3,847,383 | A | 11/1974 | Wojtowicz et al. | |
| 4,368,973 | A * | 1/1983 | Silverberg | 399/373 |
| 4,643,413 | A | 2/1987 | Ward et al. | |
| 4,822,022 | A | 4/1989 | Attenasio | |
| 5,090,676 | A | 2/1992 | Matsuno et al. | |
| 5,110,110 | A * | 5/1992 | Wirz et al. | 271/98 |
| 5,232,213 | A * | 8/1993 | Parsons et al. | 271/95 |
| 5,645,274 | A | 7/1997 | Ubayashi et al. | |
| 5,671,920 | A | 9/1997 | Acquaviva et al. | |
| 5,893,554 | A * | 4/1999 | Okahashi et al. | 271/98 |
| 6,015,144 | A | 1/2000 | Yoshii et al. | |
| 6,082,728 | A | 7/2000 | Ubayashi | |
| 6,120,016 | A | 9/2000 | Watkiss | |
| 6,497,553 | B2 | 12/2002 | Illingworth et al. | |
| 6,565,321 | B1 | 5/2003 | Illingworth et al. | |
| 6,595,753 | B1 | 7/2003 | Illingworth et al. | |

(Continued)

FOREIGN PATENT DOCUMENTS

| | | | |
|---|---|---|---|
| DE | 102007022700 | A1 | 11/2008 |
| EP | 1975735 | A1 | 10/2008 |

(Continued)

OTHER PUBLICATIONS

Co-pending U.S. Appl. No. 12/900,029, filed Oct. 7, 2010 entitled "Stack Feeding Aeration Device and Method".

(Continued)

*Primary Examiner* — Luis A Gonzales
(74) *Attorney, Agent, or Firm* — Leydig, Voit & Mayer, Ltd.

(57) ABSTRACT

A system for separating an article from the outer part of a stack and conveying it along a transfer path includes a stack assembly configured to receive a stack of articles. A mounting assembly including at least one vortex suction unit is disposed so as to face the stack of articles at least one of a leading edge and a trailing edge thereof. The vortex suction unit includes a conveyor configured to transport an article from the stack.

26 Claims, 14 Drawing Sheets

(56) References Cited

U.S. PATENT DOCUMENTS

| | | | | |
|---|---|---|---|---|
| 6,729,614 | B2 | 5/2004 | Kato et al. | |
| 6,729,839 | B1 | 5/2004 | Illingworth et al. | |
| 7,204,672 | B2 | 4/2007 | Sewell | |
| 7,364,150 | B2 * | 4/2008 | Nakane | 271/97 |
| 7,841,591 | B2 | 11/2010 | Ueda et al. | |
| 7,913,993 | B2 * | 3/2011 | Kosugi et al. | 271/98 |
| 2005/0133980 | A1 | 6/2005 | Koga | |
| 2008/0237968 | A1 | 10/2008 | Suzuki | |
| 2010/0148419 | A1 | 6/2010 | Suzuki | |

FOREIGN PATENT DOCUMENTS

| | | | |
|---|---|---|---|
| GB | 2295799 | A | 6/1996 |
| GB | 2343879 | A | 5/2000 |
| JP | 62016947 | A | 1/1987 |

OTHER PUBLICATIONS

Co-Pending U.S. Appl. No. 12/717,505, filed Mar. 4, 2010, entitled "System for conveying an article using vortex suction units".

* cited by examiner

VORTEX SUCTION SEPARATOR DEVICE

FIELD

The present invention relates generally to conveyance systems, and more specifically to a system for separating an article from a stack using vortex suction units.

BACKGROUND

In the conveyance of paper, or other articles and substrates, often times the handling of stacks is required. When articles are stacked and a single article needs to be moved from the top of the stack, often times static and frictional adhering forces make it difficult to smoothly move the top article from the stack. This is particularly a problem when handling heavy or glossy media.

European Patent Application No. EP 1 975 735 describes use of radial blowers and a duct system forming low pressure suction chambers to aerate the sides of the stack and to adhere the top sheet in the stack to a belt.

U.S. Pat. No. 6,082,728 describes use of an axial fan likewise running through a duct as a low pressure suction chamber on the opposite side of a belt from paper being conveyed thereon to lift the uppermost sheet from a stack. The uppermost sheet is first separated from the stack using an air knife providing compressed air from a duct system to below the uppermost sheet.

U.S. Pat. No. 6,565,321 describes a vortex attractor. An impeller including a plurality of radial blades extending in a direction of the rotation axis is provided to generate a vortex flow. The vortex flow provides a central negative low pressure region which can be used to attract an object.

SUMMARY

In an embodiment, the present invention provides a system for separating an article from the outer part of a stack and conveying it along a transfer path that includes a stack assembly configured to receive a stack of articles. The system includes a mounting assembly including at least one vortex suction unit disposable so as to face the stack of articles at least one of a leading edge and a trailing edge thereof. The at least one vortex suction unit includes a conveyor configured to transport an article from the stack.

BRIEF DESCRIPTION OF THE DRAWINGS

The foregoing and other features of the present invention will be more readily apparent from the following detailed description and drawings of illustrative embodiments of the invention in which.

Like reference numerals are used in the drawing figures to connote like components of the system.

DETAILED DESCRIPTION

Figure 1:
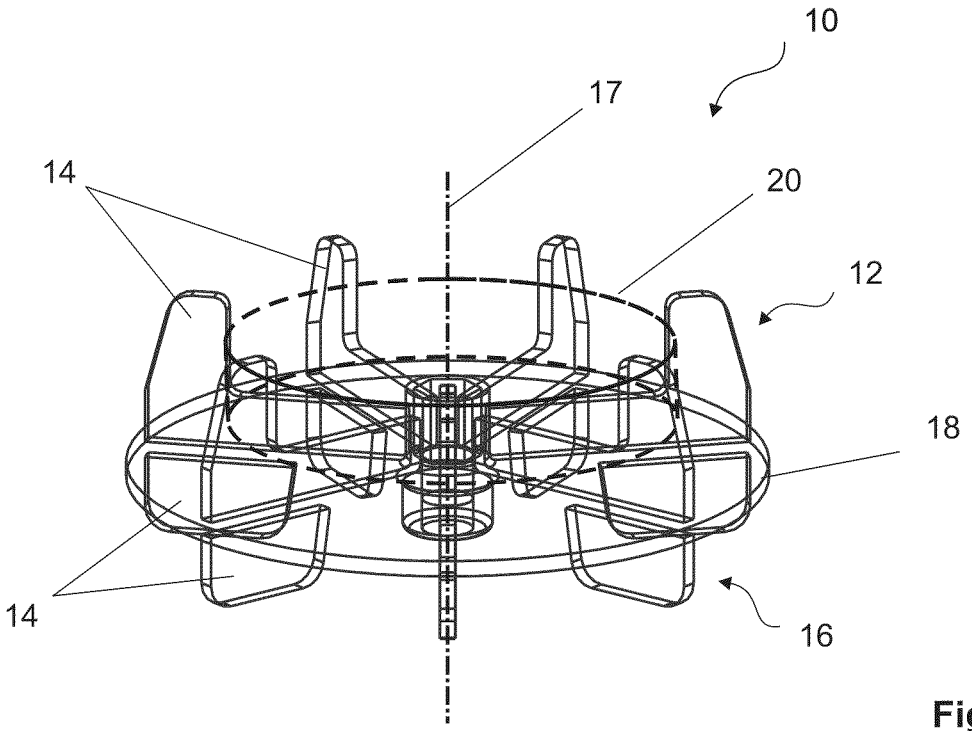
FIG. 1 is a front view of a vortex suction unit in accordance with an embodiment of the present invention.
Figure 2:
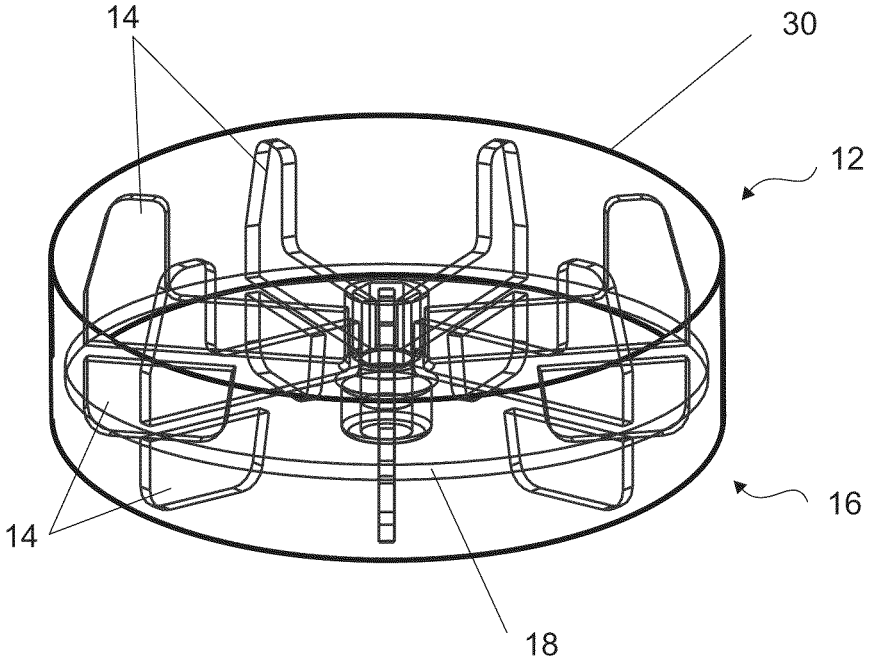
FIG. 2 is a perspective view of the impeller of a vortex suction unit according to FIG. 1, with the impeller surrounded by a cylindrical ring.
Figure 3:
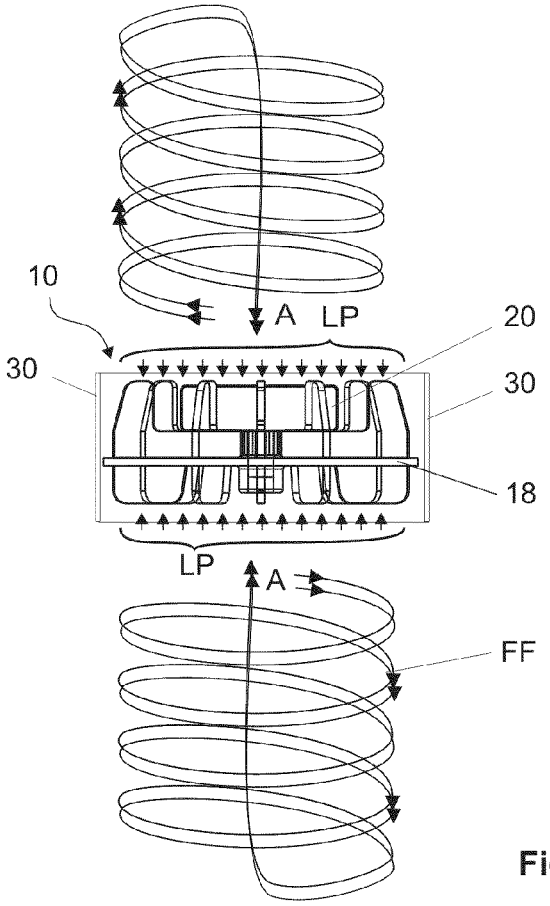
FIG. 3 is a schematic view of the fluid flow generated by a vortex suction unit.

Referring to FIGS. 1-3, a vortex suction unit 10 includes an upper vortex generator 12 driven by a motor 20. The upper vortex generator 12 includes an impeller having a base 18 concentrically driven about an impeller axis 17 by the motor 20 and a plurality of blades 14 radially disposed on the base 18 and extending perpendicularly upwards therefrom. In an embodiment, a similar lower vortex generator 16 including blades 14 is provided on the opposite side of the base 18 in order to provide a cooling flow of air to the body of the motor 20. However, in one embodiment, only the lower vortex generator 12 is provided to generate the attraction force A based upon the principles of a tornado. The motor 20 may be an AC or DC motor. For example, the motor 20 is a brushless DC motor or a stepper motor. The blades 14 may be a number of different shapes, such as curved. In an embodiment, the blades 14 are substantially straight and flat. For example, the blades 14 of the upper vortex generator 12 may include a recessed portion at an upper, inward and radially-extending portion, providing space for the motor 20. In other embodiments, the blades 14 may have alternative configurations, for example not including such an upper, inward and radially-extending portion. A housing 30 may be provided on the vortex suction unit 10 surrounding the peripheral edge of the base 18 and blades 14. The housing 30 may be, for example, a shell or a ring. Alternatively, the upper vortex generator 12 and/or the lower vortex generator 16 may be manufactured, for example, by molding, to form a ring surrounding the blades 14.

A vortex suction unit 10 is any device capable of generating a vortical fluid flow FF. By way of example, a vortex attractor as described in U.S. Pat. No. 6,565,321 or in U.S. Pat. No. 7,204,672, which are hereby incorporated by reference herein, may be used. Preferably, however, a vortex suction unit as described in U.S. application Ser. No. 12/717,505, the entire contents of which are hereby incorporated by reference herein, is used. The radially extending blades 14 generate the fluid flow FF helically containing a low pressure region LP within the vortex generator 12 inside the peripheral edges of the blades 14. An attraction force A is generated in the low pressure region LP which allows the vortex suction unit 10 to both attract and move toward (when the vortex suction unit 10 is not fixed) the surface of an object. Vortex suction units 10 are effective to removably adhere to planar and non-planar surfaces or to maintain the same at a predetermined distance. It is also noted that the vortex suction unit 10 may be configured to apply a negative attraction force A, or a repulsion force, to push an article 50 away.

Figure 4:
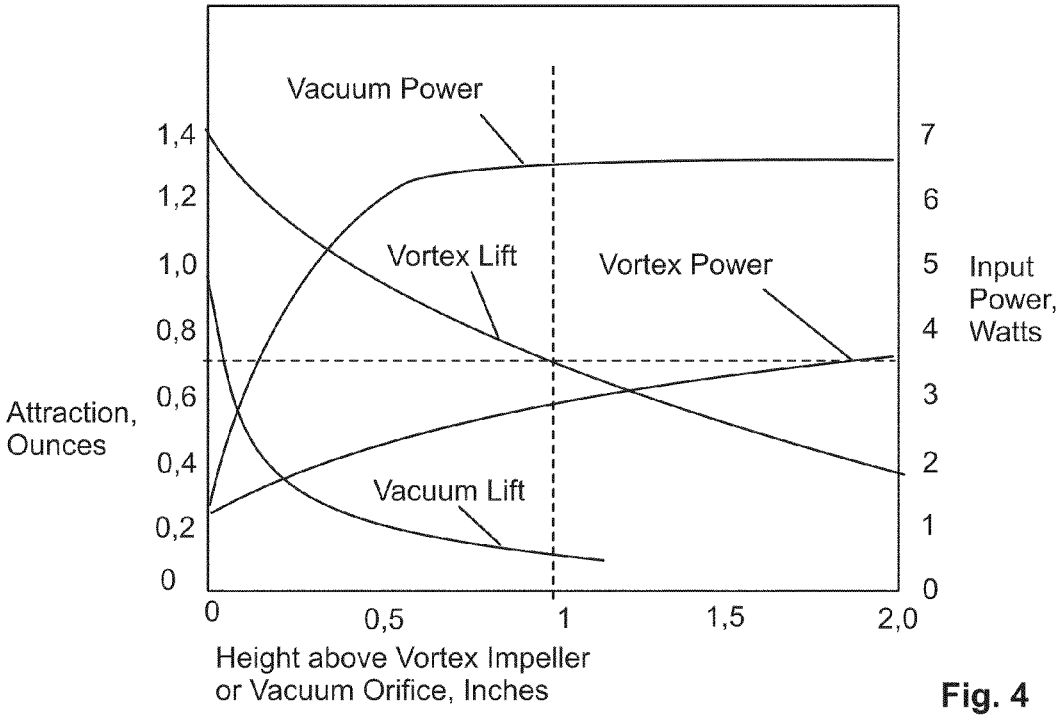
FIG. 4 a graph comparing attraction force and power consumption of vortex suction units and standard axial fans.

In one embodiment, the upper and lower vortex generators 12, 16 are formed from a lightweight material, such as plastic, and have a diameter of approximately 50 mm. In this manner, the rotational inertia is kept low such that the vortex suction module can be started and stopped quickly. Likewise, the speed may be adjusted quickly and easily. The motor 20 is a brushless DC motor which responds quickly to changes in power level to adjust its rotations per minute (rpm). At about 22,000 rpm, the vortex suction unit 10 generates an attraction force A of about 1.3 N throughout the low pressure region LP. Referring to FIG. 4, a comparison is made for illustrative purposes between a vortex impeller and a vacuum suction chamber having a fan configured for low pressure generation (vacuum power). In addition to being responsive to power changes to quickly change speed and thereby increase or decrease its attraction force, the vortex impeller is also far more efficient and effective than the vacuum system when at a distance from an object to be adhered; this is a desirable positioning for proper conveyance to allow room for belts and/or prevent sticking. For example, where the article 50 is disposed at a distance of 1.0 mm from the upper vortex generator 12, an attraction of approximately 0.7 ounces is achieved while consuming only about 3.5 Watts of power. In contrast, at the same distance of 1.0 mm, the fan of the vacuum generator consumes approximately 6.5 Watts of power while providing attraction for only about 0.1 ounces.

Figure 5:
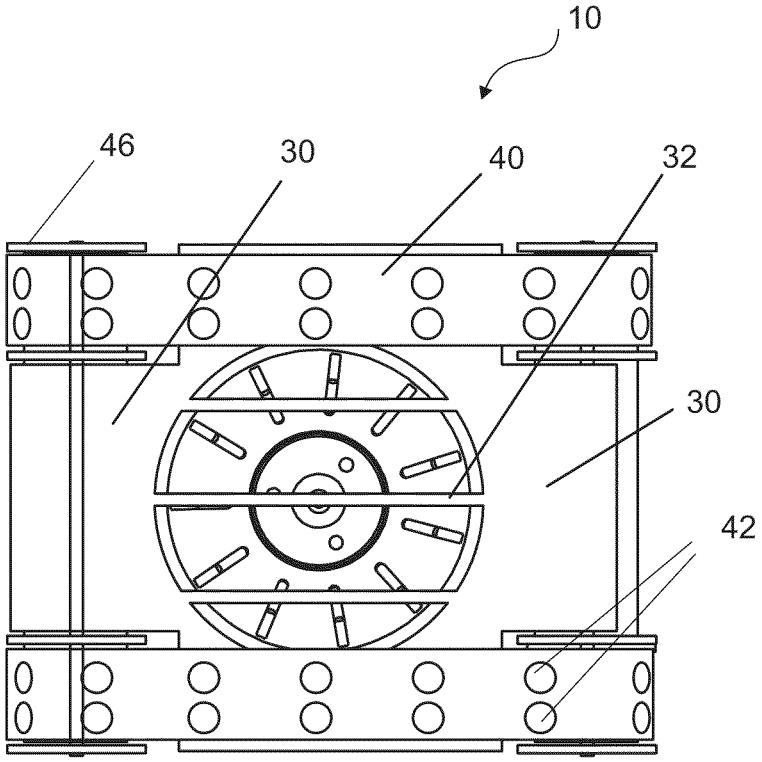
FIG. 5 is a plan view of a vortex suction unit having its own means of conveyance.
Figure 6:
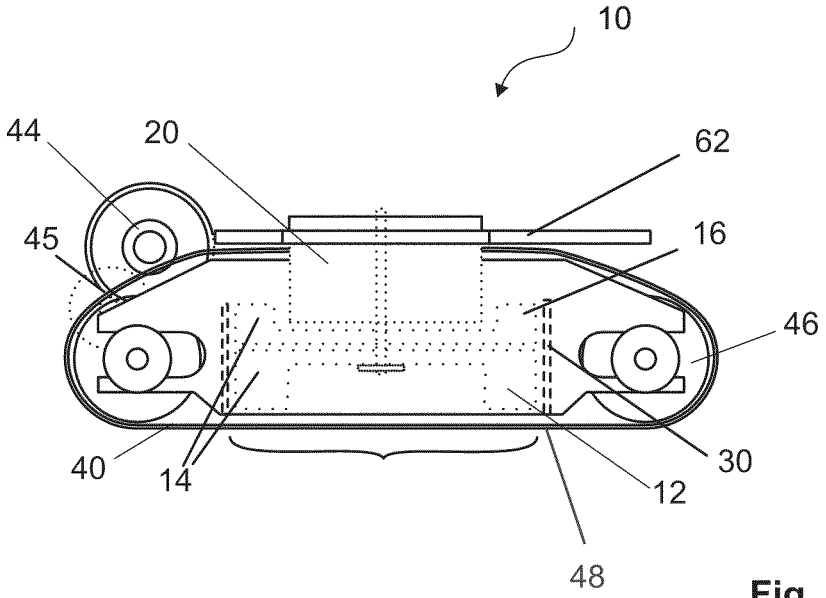
FIG. 6 is a sectional side view of the vortex suction unit of FIG. 5.
Figure 7A:
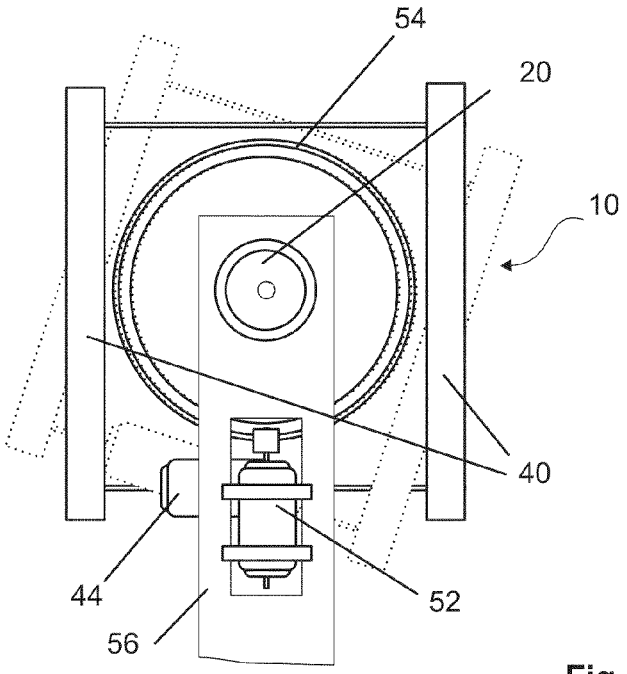
FIG. 7 is a plan view of the vortex suction unit of FIG. 5 provided with means for rotating the unit.
Figure 7B:
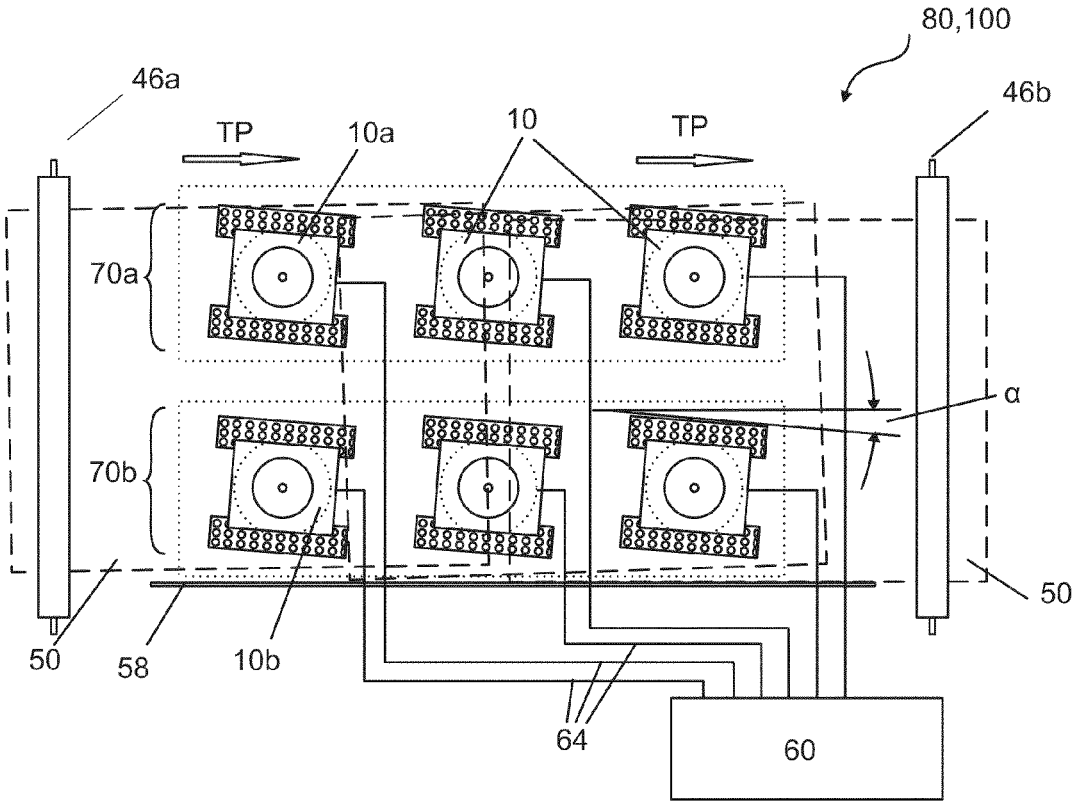
Figure 8A:
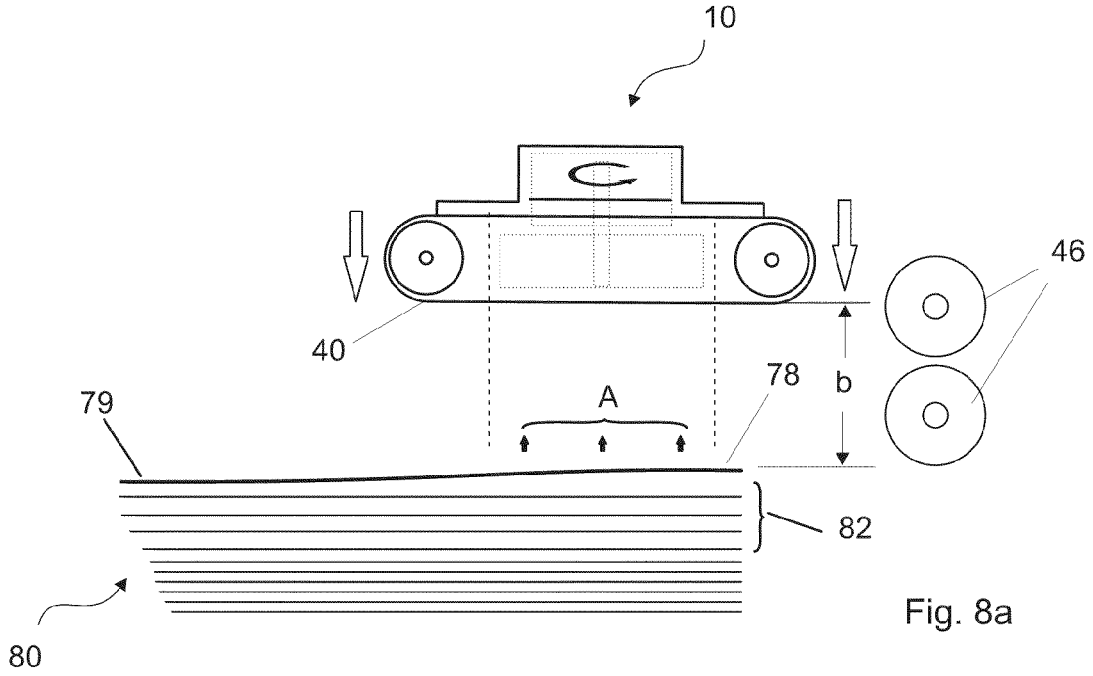
FIG. 8*a* is a side view of a vortex suction unit positioned above a stack of articles in accordance with an embodiment of the present invention.
Figure 8B:
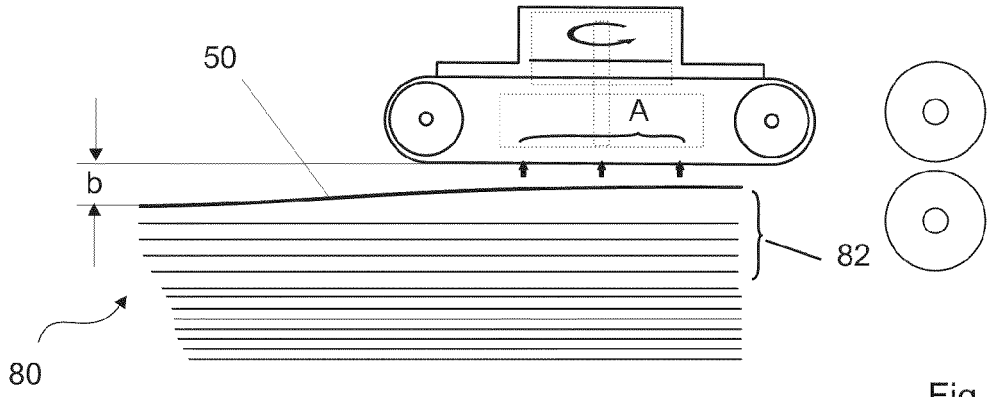
FIG. 8*b* is a side view of the vortex suction unit of FIG. 8*a* lifting the uppermost article from the stack.
Figure 8C:
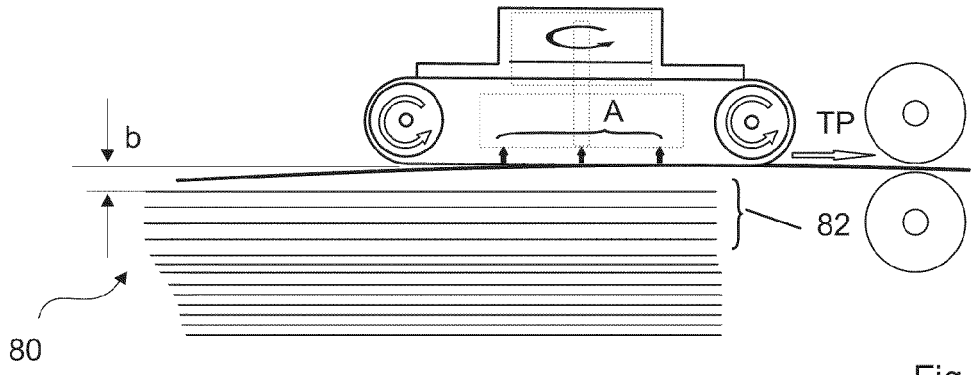
FIG. 8*c* is a side view of the vortex suction unit of FIGS. 8*a* and 8*b* conveying the uppermost article away from the stack.
Figure 9A:
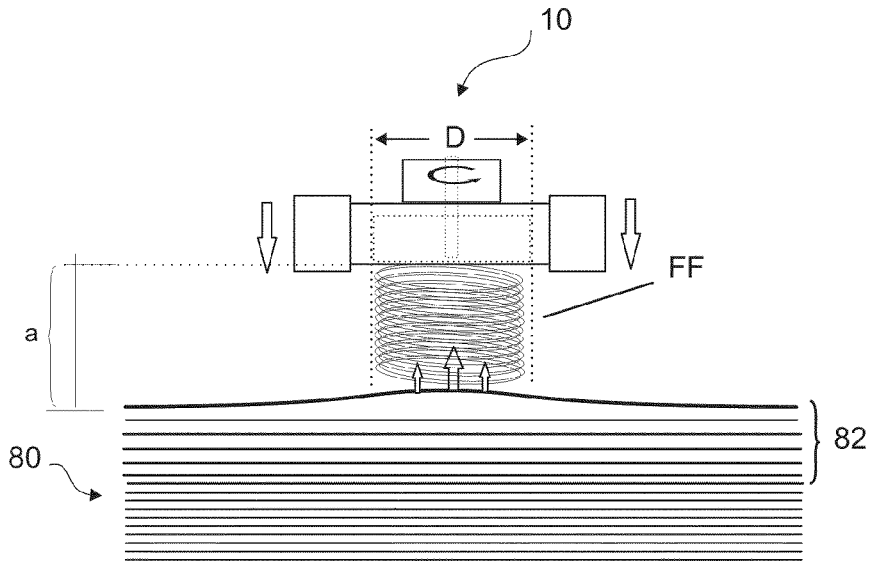
FIG. 9*a* is a front view of FIG. 8*a;*
Figure 9B:
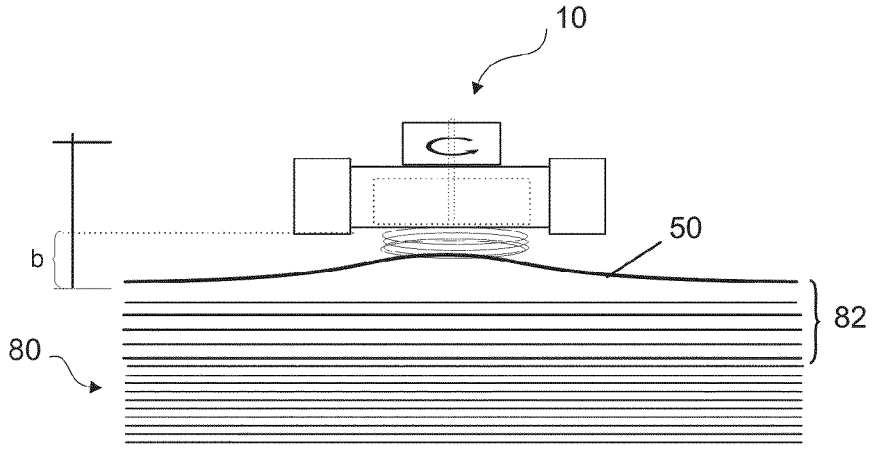
FIG. 9*b* is a front view of FIG. 8*b;*
Figure 9C:
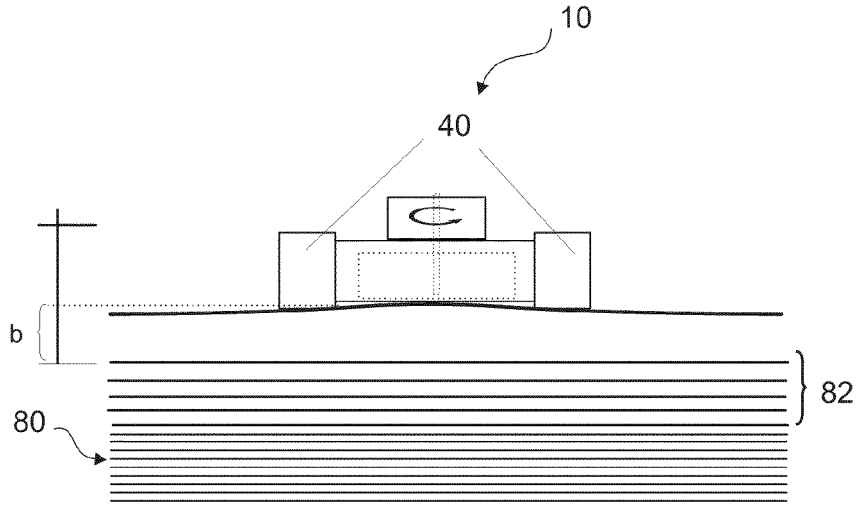
FIG. 9*c* is a front view of FIG. 8*c;*

Referring to FIGS. 5-7, each vortex suction unit 10 may be provided with a means of conveyance, such as, for example, its own pair of belts 40 that are driven by traction rollers 46 connected to a belt drive 44. The attraction force generated by the vortex suction unit causes an article to press against a contact surface 48 of belts 40, so that movement of the belts causes a corresponding transport of the article, for example at an angle, e.g., orthogonal, to the impeller axis. In some embodiments, belts 40 may have various perforation distributions or shapes, or no perforations at all. A cover 32 having ribs is provided on the housing 30 over the upper vortex generator 12 parallel to the belts 40 to provide a slight corrugation to flexible articles 50 in conveyance direction and to minimize friction as the article 50 moves across the cover 32. In an embodiment, the housing 30 surrounds the upper and lower vortex generators 12, 16, or at least the lower vortex generator 12. Additionally, each vortex suction unit 10 may also be provided with its own modular controller 62 which is functionally coupled with the motor 20 and/or the belt drive 44 to control the speed of the vortex suction unit 10 and belts 40 by varying power levels provided thereto.

Each vortex suction unit 10 may also be provided with its own means for rotation, such as a rotation motor 52 connected to a crown gear 54 disposed on a rear surface of the vortex suction unit 10. The rotation motor 52 is attached to a support 56 which is fixed at one end and at the other end is rotatably connected to the vortex suction unit 10 at the axis of rotation of the motor 20. The main controller 60, directly through control lines 64 or through a modular controller 62, provides power to the rotation motor 52 in order to rotate the crown gear 54 and position a vortex suction unit 10 at a particular alignment angle $\alpha$. Further, the angular rotation of individual vortex suction units 10, which may be provided for both vertically and horizontally, can provide for numerous different, complex transfer paths TP in three-dimensions, and also allows for quick adjustments in transfer paths TP and for changes in alignment of articles 50 therein. For example, such rotatable vortex suction units 10 could be rotated before and or while holding an article 50 to distribute it to various conveyors 80 or belts 40 of other vortex suction units 10 disposed horizontally at angles to its own belts 40 and/or positioned vertically above or below.

The housings 30 of the vortex suction units 10 may be square or other shapes and surround the outside edges of the blades 14. A cover 32, which may be a screen, a grid, concentric circles, an air permeable material, a plate with openings or ribs, may be provided on the vortex suction units 10. In an embodiment shown in FIG. 5, the cover 32 includes ribs extending in the direction of the transfer path TP such that an article 50 which is flexible, such as paper, is provided a slight corrugation in the direction of the transfer path TP. The housing 30 may also include idler balls or rollers which contact the article 50 during conveyance to decrease friction.

The cover 32 may be provided to minimize risk of injury, keep objects from interfering with the blades, to maintain a spacing to the article 50 and/or to aid in guiding and supporting the article 50 as it moves along the transfer path TP. In an embodiment, the cover 32 is disposed at a distance from the article 50 such that a flexible article 50 being carried by belts 40 is given a concave or corrugation shape by vortex suction units 10 positioned between pairs of belts 40, thereby imparting a degree of rigidity to the article.

The belts 40 may be formed from a material having a significant coefficient of friction and may be toothed, such as in a synchronous type conveyor, textured or profiled. For example, spikes, grooves or ribs may be provided on the surface of the belts 40. Typical elastic or elastomeric belts 40 are sufficient to convert the normal force into a transport force. The surface of belts 40 may be roughened to increase friction in their entirety or only at certain areas to create a surface having regions with different coefficients of friction. Further, the belts 40 may be at least partially air permeable. For example, the belts 40 may have perforations 42 or be formed from a nano-material. The belts 40 may be driven by a belt drive 44, which may be adjustable to control the conveyance speed.

Referring to FIGS. 8*a-c* and 9*a-c*, a vortex suction unit 10 is shown lifting and transferring the uppermost article 50 on the top of a stack 80 (in the embodiment shown, an aerated portion 82) along a transfer path TP and through a pair of exit rollers 46. The vortex suction unit 10 is positioned over the leading edge 78 of the stack 80 at a distance b such that the attraction force A over the low pressure area LP is sufficient to lift the uppermost article 50. The distance b from which the uppermost article 50 is positioned from the vortex suction unit 10 depends on the size of the diameter D of the circular area, or orifice, and the speed of the vortex suction unit 10, as well as the mass, size and material of the article 50. For example, with a diameter D of about 50 mm and a speed of 18,000 rpm, a vortex suction unit 10 can lift an article 50 of about 70 grams from a distance b of 6 to 8 mm, when a surface of the article offers at least a flat area having a size similar to the circular area of the impeller. Lifting can occur, however, even at a distance a of up to about 60 mm from an article 50 that is a 11" sheet material, such as paper, with a specific weight of up to about 75 g/m$^2$ using the vortex suction unit 10. Additionally or alternatively, a vortex suction unit 10 may be disposed at the trailing edge 79 of the stack 80.

Due to the high suction force, the suction module also is able to separate substrates in bottom feeding mode where the outmost sheet is the lowermost sheet of the stack. Separation of sheets of stacks of flat substrates is possible with the substrate stack positioned in virtually all angles with respect to the horizontal. In a preferred bottom feed mode wherein a reload of the substrate stack is possible while separating sheets, the substrate stack and the suction unit's belt surface is positioned in a 60° angle to the horizontal which advantageously reduces the gravity related pressure between the sheets which facilitates the separation of the outmost sheet accordingly. An angle of the contact surface 48 and/or an angle of the impeller axis 17 relative to the stack may be varied. In some embodiments, the angle of the contact surface 48 and the angle of the impeller axis may be varied independently of each other.

The adhesion force A in the low pressure region LP that must be provided in order to lift the uppermost article 50 depends upon the type of articles 50 in the stack 80. For example, when handling heavy, glossy media, adjacent sheets have a greater tendency to adhere to one another due to higher mass, a smooth surface, a static adhesion force and/or a higher co-efficient of friction of the glossy media. Different types of articles 50 also accumulate static charges which can cause adjacent articles to attract and adhere to one another, especially in central regions. In order to ensure a smooth separation of only the uppermost article 50, it has been found that positioning the vortex suction unit 10 over a leading edge 78 and/or a trailing edge 79 of the stack 80 achieves a gradual separation wherein the uppermost article 50 is first more easily adhered by lifting at an edge and gradually separated while conveying along a transfer path TP.

In some embodiments, the vortex suction unit may be operated so as to be at times turned off or operated at times in a partial blowing mode.

Figure 10A:
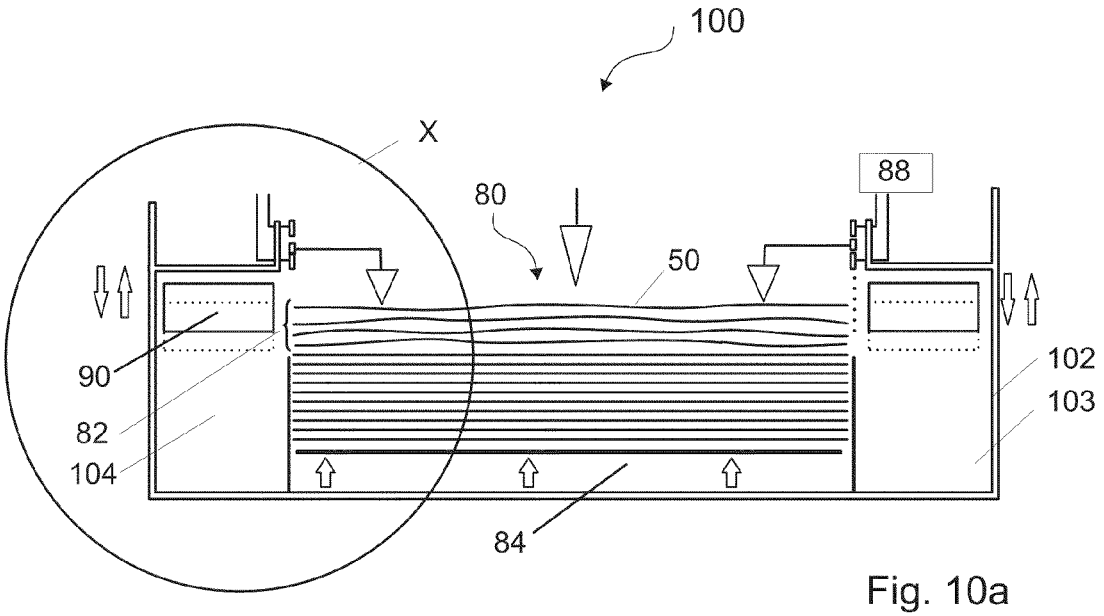
FIG. 10*a* is a schematic sectional view of a stack assembly in accordance with an embodiment of the present invention.
Figure 10B:
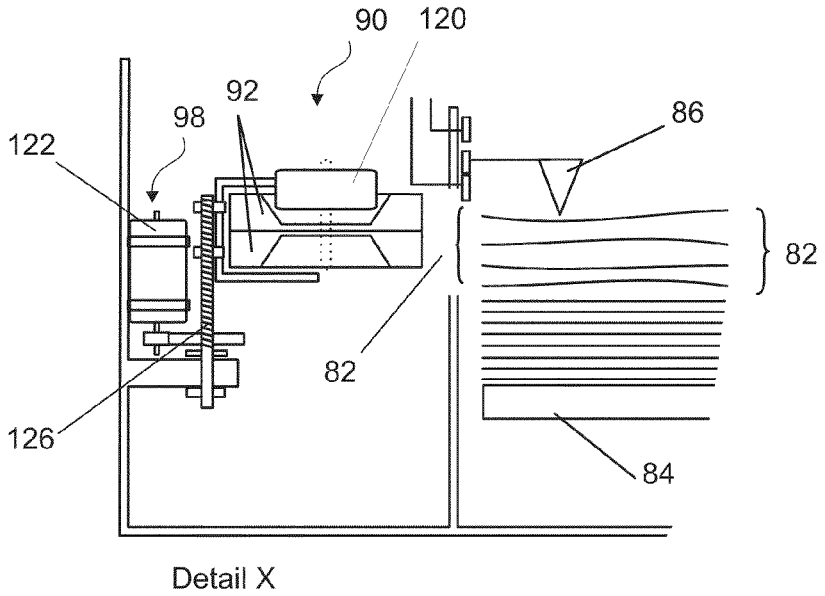
FIG. 10*b* is a detailed view of detail X of FIG. 10*a;*
Figure 11:
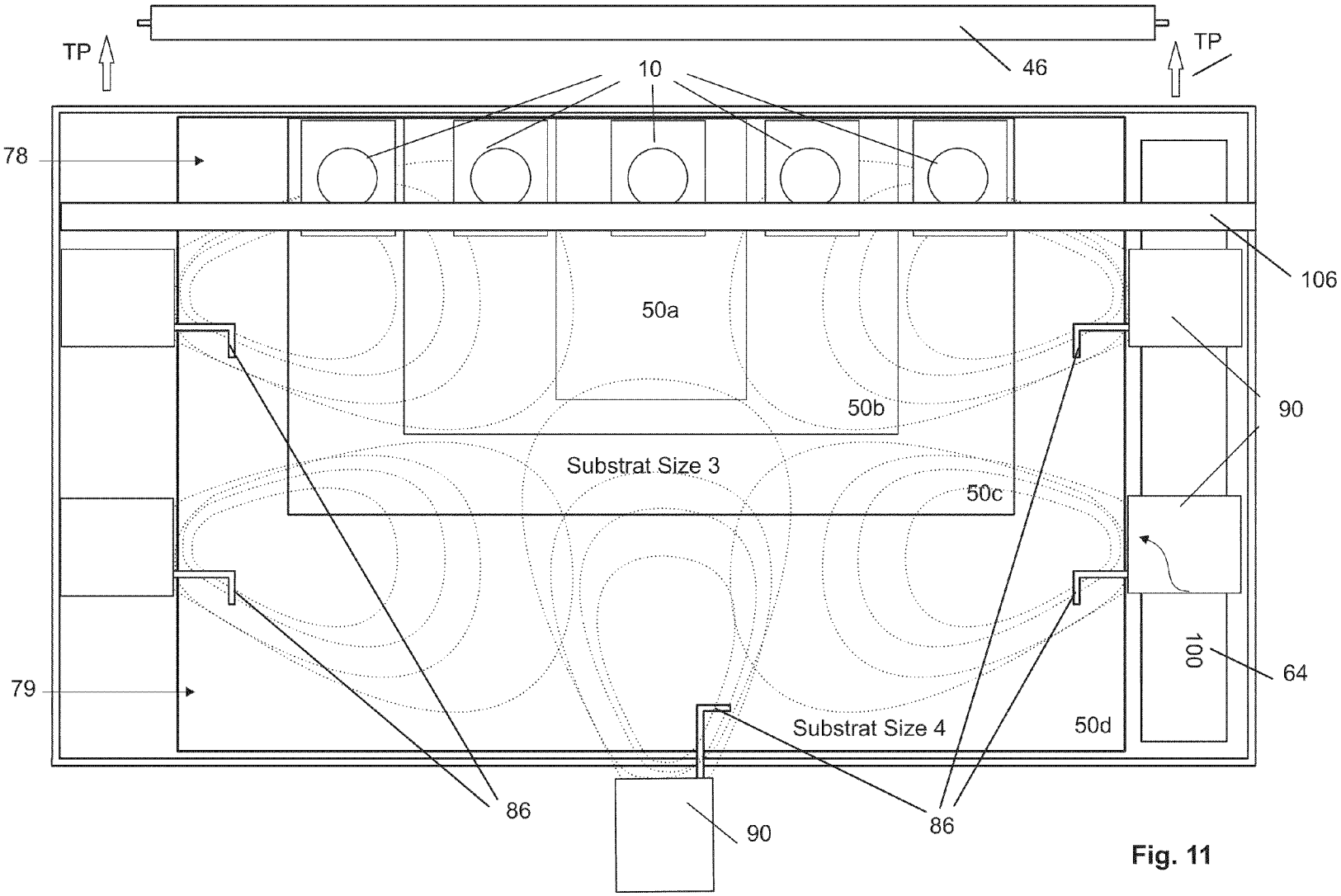
FIG. 11 is a top view of a stack assembly according to an embodiment of the present invention.

Referring to FIGS. 10*a*, 10*b* and 11, a stack assembly 100 according to an embodiment of the present invention includes a frame 102 and possibly adjustable side blowers 90 mounted within first and second side sections 103, 104 thereof. The side blowers 90 may be provided on one or several or even all sides of the stack 80. Further, the speed and height of side blowers 90 can be asynchronously controlled. For example, operating side blowers 90 at the leading edge 78 at an increased height and speed relative to side blowers 90 at the trailing edge 79 can result in increased separation in the aerated portion 82, especially at the leading edge 78. In the embodiment shown in FIG. 11, side blowers 90 are provided at each side between the leading and trailing edges 78, 79, as well as at the trailing edge 79. The height of the stack 80 can be measured and/or controlled using one or more stack height sensors 86, which may be, for example, optical fork sensors. A lift table 84 disposed beneath the stack 80 can be used to lift the stack 80 upwards, for example, such that the uppermost article 50 is always disposed at a predetermined height relative to a vortex suction unit 10 mounted above the stack 80. The stack height sensors 86 can be regulated by one or more sensor controller 88 and the height of the side blowers 90 may be adjusted by the sensor controller 88 and/or by one or more lift controllers 64 so that the adjustable side blowers 90 are positioned adjacent the uppermost articles 50 of the stack 80 and provides an aerated portion 82 at the top portion thereof. In other embodiments, other types of aerating devices may be used in place of side blowers 90.

In the embodiment shown in FIG. 10*b*, each side blower 90 includes a radial impeller 92 and a radial impeller motor 120 to aerate the top portion of the stack 80. Alternatively or additionally, one or several air knives directing compressed air between the articles 50 in the aerated portion 82 can be used. The height of the side blowers 90 in the first and second side sections 103, 104 is adjustable relative to side apertures 96 in the frame 102 of the stack assembly 100 using a height adjustment device 98. One such height adjustment device 98 includes a lift motor 122 which moves a respective side blower 90 up and down along a vertical spindle 126. The side apertures 96 are disposed adjacent a predetermined portion of the top of the stack 80 such that air provided radially from the side blowers 90 extends between the articles 50 and separates them from one another in an aerated portion 82. Accordingly, the frictional and static adhesion forces between adjacently stacked articles 50 can be substantially eliminated in the aerated portion 82 as an uppermost article 50 will float above the stack 80, thereby allowing a vortex suction unit 10 to adhere the uppermost article 50 from a distance without disturbing the rest of the stack 80 or unintentionally adhering more than one article, i.e. a double-pick. Alternatively, however, other means may be employed to reduce or break adhesion and/or electrostatic forces between the articles. For example, electromagnetic, electromechanical or motor-driven vibrating devices, able to slightly vary the position of the individual substrates relative to each other, thereby reducing friction and static forces, may be used.

Referring to FIG. 11, a plurality of vortex suction units 10 are disposed over the stack 80 and distributed evenly along the leading edge 78, for example, along mounting bar 106, so that first, second, third and fourth articles 50*a-d* of various sizes can be lifted from the stack 80 by separately controlling each of the vortex suction units 10. For example, when a first article 50*a* of a smaller size is lifted, only the center vortex suction unit 10 can be operated while when a larger fourth article 50*d* is lifted, all of the vortex suction units are operated.

Figure 12A:
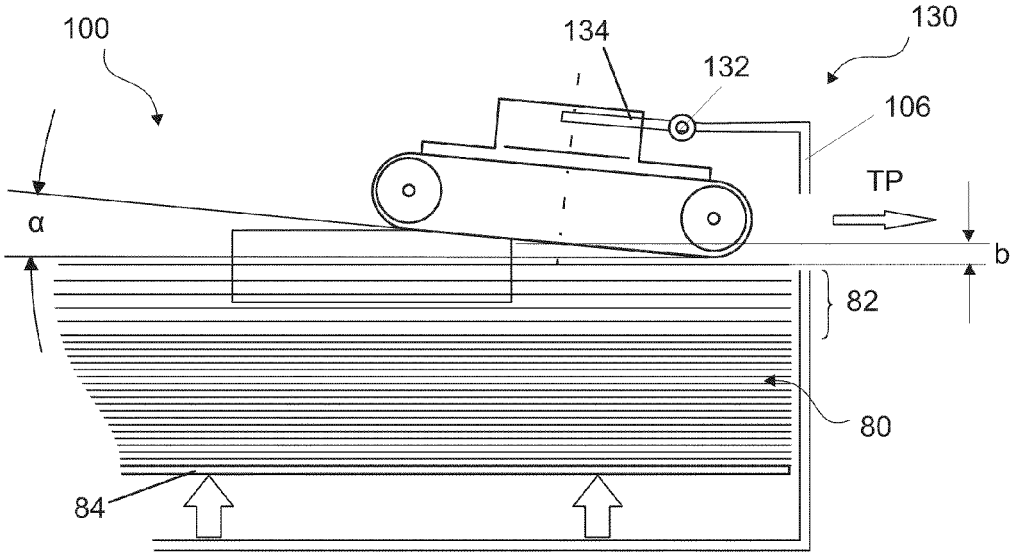
FIG. 12*a* is a sectional side view of a stack assembly with a vortex suction unit having means for adjusting the angle of the vortex suction unit relative to the stack.
Figure 12B:
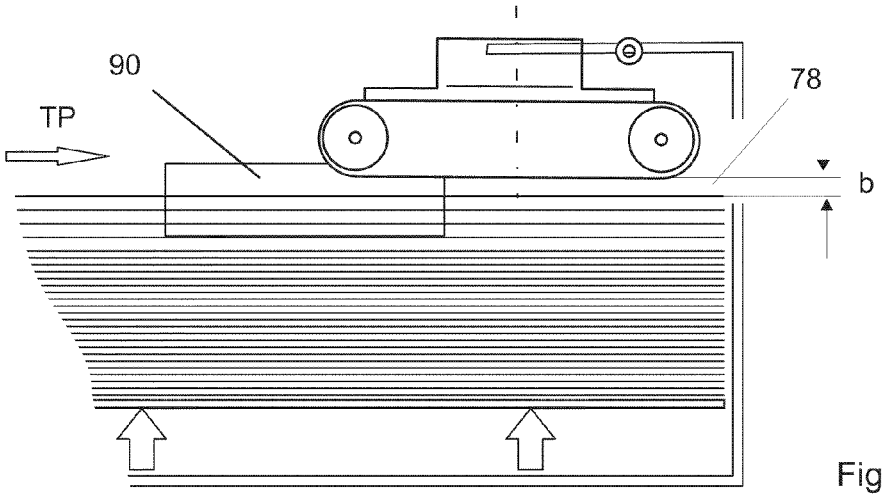
FIG. 12*b* shows the stack assembly of FIG. 12*a* with the vortex suction unit having a different angular position.
Figure 12C:
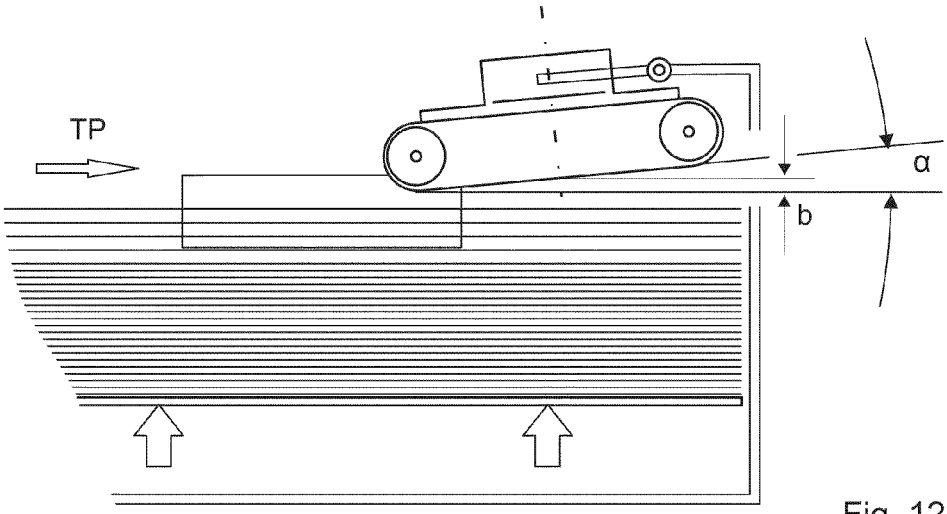
FIG. 12*c* shows the stack assembly FIGS. 12*a* and 12*b* with the vortex suction unit having a further angular position.

Referring to FIGS. 12*a-c*, a first embodiment of a mounting assembly 130 for positioning the vortex suction unit 10 over the leading edge 78 of an aerated portion 82 of the stack 80 includes a lever 134 pivotally connected to a mounting bar 106 at pivot 132. A motor or other known means can be used to rotate the lever 134 at pivot 132. Accordingly, the vortex suction unit 10 can be disposed at an angle $\alpha$ relative to the uppermost article 50 of the stack 80. It has been found that the uppermost article 50 can be more easily separated from the stack 80 by disposing the vortex suction unit 10 at an angle relative to the surface of the uppermost article 50 rather than parallel to the surface. With this angled arrangement, a portion of the uppermost article 50, for example, the peripheral side of the leading edge 78 (see FIG. 12*c*), can be lifted to a different height than the portion of the uppermost article 50 that is adhered on the opposite side of the circular area of the vortex suction unit 10. A more gradual separation of the uppermost article 50 from the subsequent one in the stack 80 is achieved than when picking from a parallel arrangement where there is a larger common surface area that will receive the same adhesion force at the same time; thus, undesired double-picks can be avoided. A positive (FIG. 12*c*) or negative (FIG. 12*a*) inclination angle is possible and can be chosen based on whether the vortex suction unit 10 is placed at the leading or trailing edge 78, 79 of the stack 80. The angle α is preferably in the range of −45° to 45°.

In one embodiment shown in FIG. 12*c*, the vortex suction unit 10 is positioned with a center-point distance b of between 0 mm and 60 mm preferably 5 and 20 mm from the uppermost article 50 and at a positive angle α between 0° and 30°, preferably between 8° and 15° and more preferably 12°. Where a fixed distance b and angle α are desired, for example where the stack 80 always contains identical articles 50, the vortex suction units 10 may instead be fixedly arranged on the mounting bar 106. In a further embodiment, the vortex suction unit can move as the uppermost article is adhered and moved along the transfer path TP. For example, the uppermost article 50 can be gradually separated by a vortex suction unit 10 disposed at a negative angle α (see FIG. 12*a*) and, once fully adhered to the orifice, the vortex suction unit 10 can be rotated through to parallel (see FIG. 12*b*) or to a positive angle α (see FIG. 12*c*) by the lever 134. This angular rotation not only attains a gradual separation and decreases the likelihood of a double-pick, but also moves the uppermost article 50 laterally along the transfer path TP and toward an exit of the stack assembly 100. In an embodiment, the at least one vortex suction unit is disposed above or below the stack at a distance of between 0 and 60 mm.

Figure 13A:
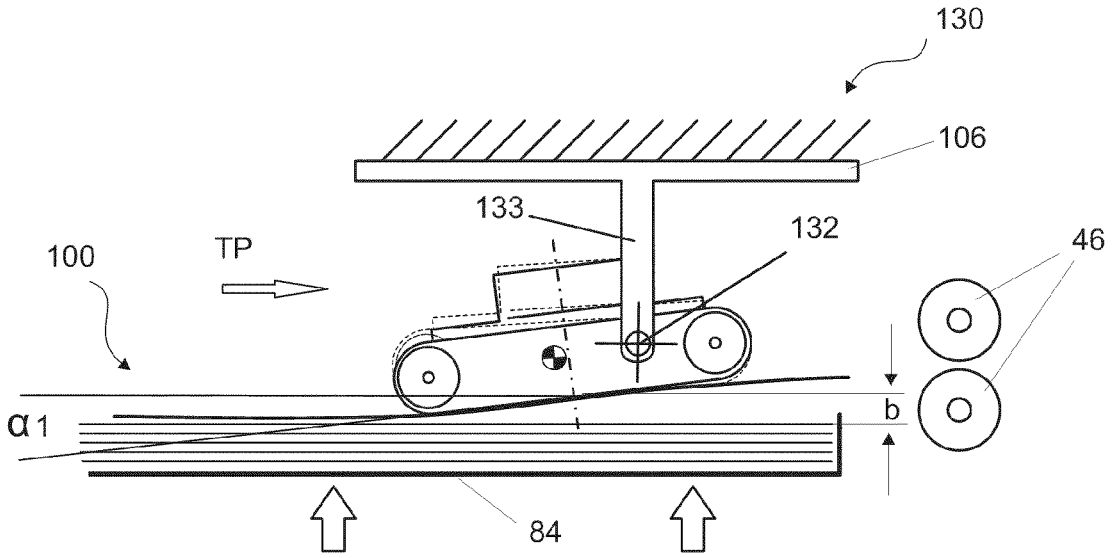
FIG. 13*a* is a sectional side view of a stack assembly with a vortex suction unit having alternate means for adjusting the angle of the vortex suction unit relative to the stack.
Figure 13B:
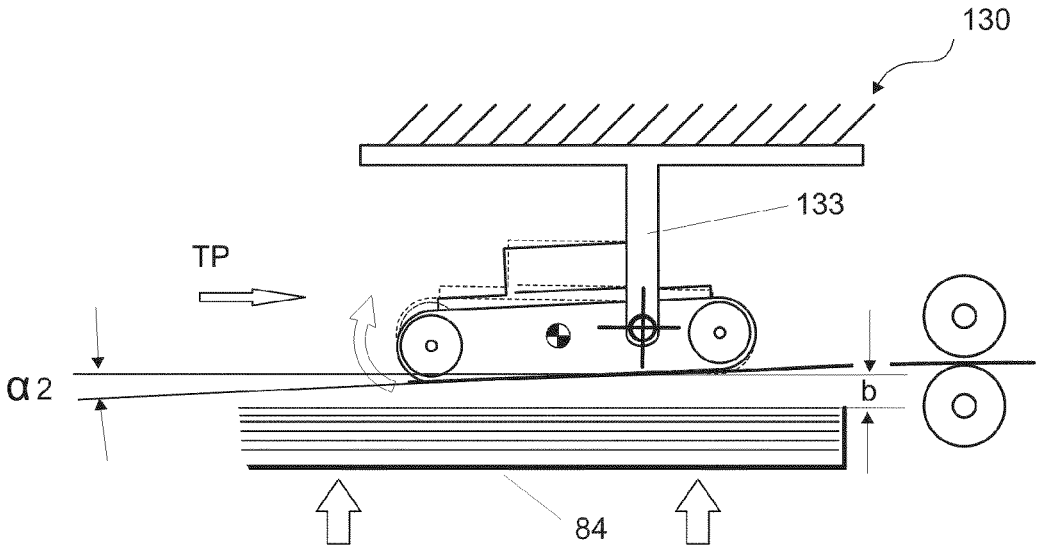
FIG. 13*b* shows the stack assembly of FIG. 13*a* with the vortex suction unit having been self-adjusted to a different angular position.

Referring to FIGS. 13*a* and 13*b*, an alternative embodiment of the mounting assembly 130 includes an extension 133 from the mounting bar 106. Vortex suction units 10 are pivotally connected to the extension 133 at pivot 132. The vortex suction units 10 may be rotated manually, but preferably a motor is attached to rotate the vortex suction unit about the pivot 132. In order to provide a mounting assembly 133 that has a self-adjusting angle α, the rotation of the vortex suction units 10 about the pivot 132 can be controlled by a main controller 60 (see FIG. 16) or modular controllers. For example, the vortex suction unit 10 can rotate toward the uppermost article 50 to a first angle α1 (until a desired angle α or a distance b for the particular article 50 is obtained) in order to gradually adhere the uppermost article 50. After the uppermost article 50 has peeled away and gradually adhered to cover the entire orifice of the vortex suction unit 10, as indicated by a significant increase in speed and decrease in current consumption of the suction motor 20, the vortex suction unit is rotated away from the stack 80 to a second angle α2 (a desired angle α or a distance b for transferring the article 50 along the transfer path is obtained). The extension 133 can also include a slot for moving the pivot 133 and the vortex suction unit 10 in the vertical direction to provide for further adjustment of distance b. Further, because the desired angle α and the desired distance b will differ with the type of articles 50, the vortex suction unit 10 can automatically adjust when the type of article 50 and its position is known.

Figure 14A:
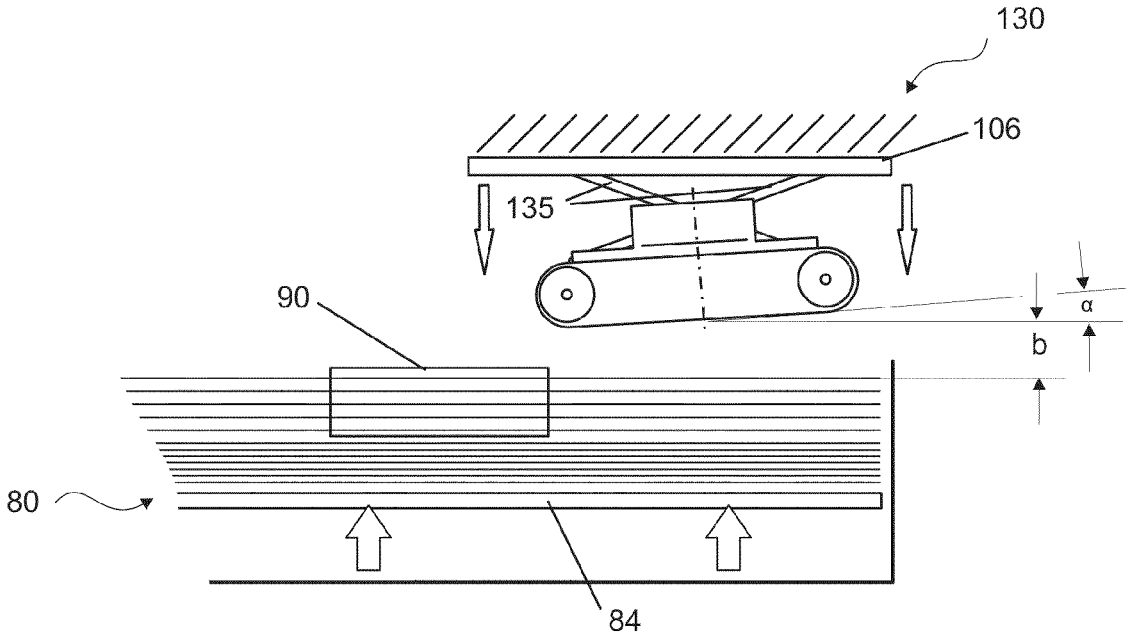
FIG. 14*a* is a sectional side view of a stack assembly with a vortex suction unit having further alternate means for adjusting the angle of the vortex suction unit relative to the stack.
Figure 14B:
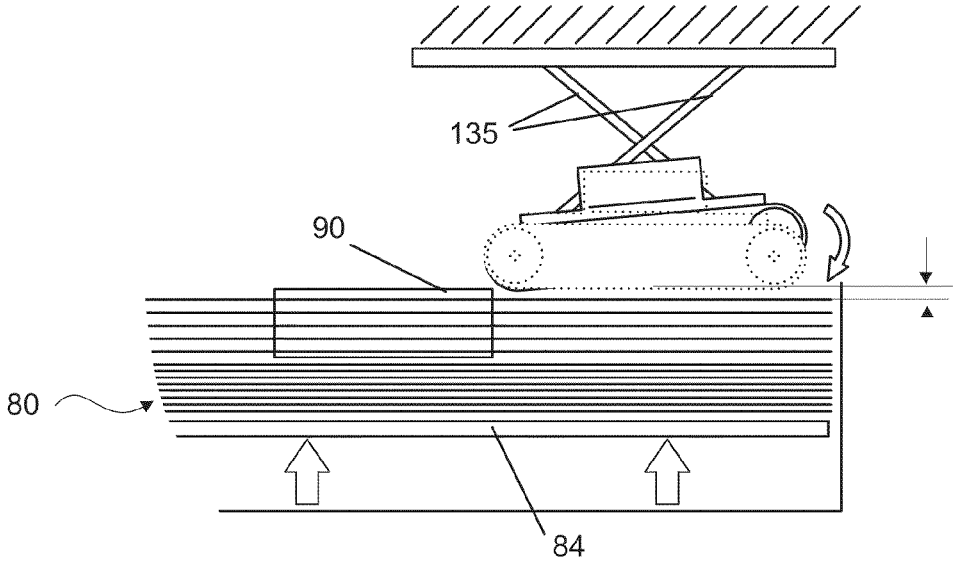
FIG. 14*b* shows the stack assembly of FIG. 14*a* with the vortex suction unit having a different angular position and height.

Referring to FIGS. 14*a* and 14*b*, a further embodiment of the mounting assembly 130 includes a pair of linkages 135 connected at one end to the mounting bar 106 and at a second end to opposite sides of the vortex suction unit 10 in order to adjust both the angle α and the distance b. The linkages 135 can be a scissor-type jack or other types of linkages which may or may not cross one another. Such shortening or lengthening arrangement can change the angle α and can change the distance b. Where the linkages cross, as shown in FIGS. 14*a* and 14*b*, the ends of the linkages 135 are slidably or rotatably retained in the mounting bar 106 and/or on the vortex suction unit 10 in order to adjust both the angle α (for example, by sliding or pivoting one linkage 135) and the distance b (for example, by sliding or rotating both linkages 135).

Figure 15A:
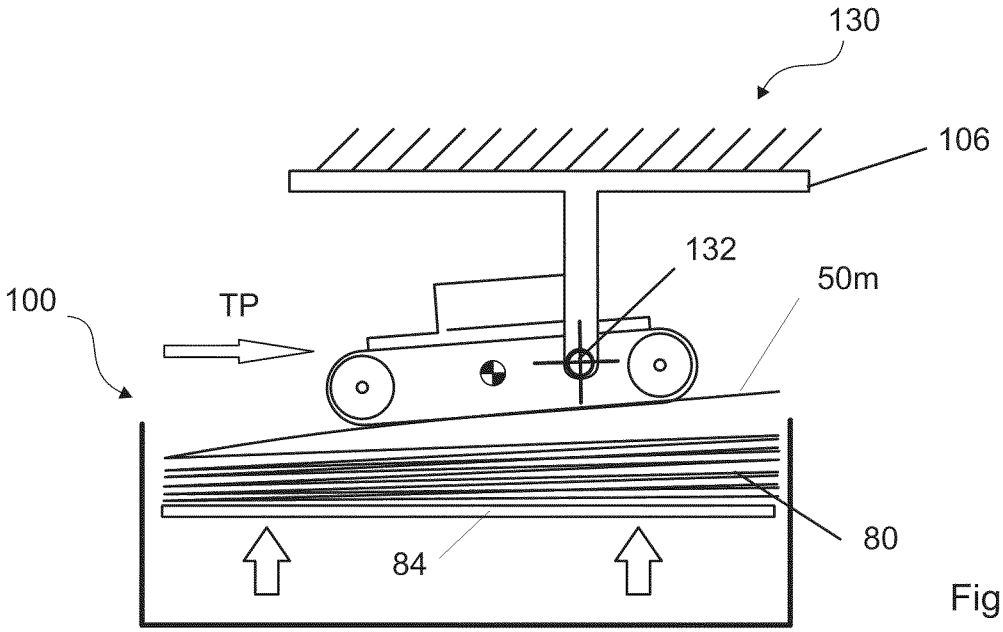
FIG. 15*a* is a sectional side view of a stack assembly and vortex suction unit with means for adjusting the height and angle of the vortex suction unit relative to the stack, the stack assembly being provided for handling multiple articles in accordance with an embodiment of the present invention.
Figure 15B:
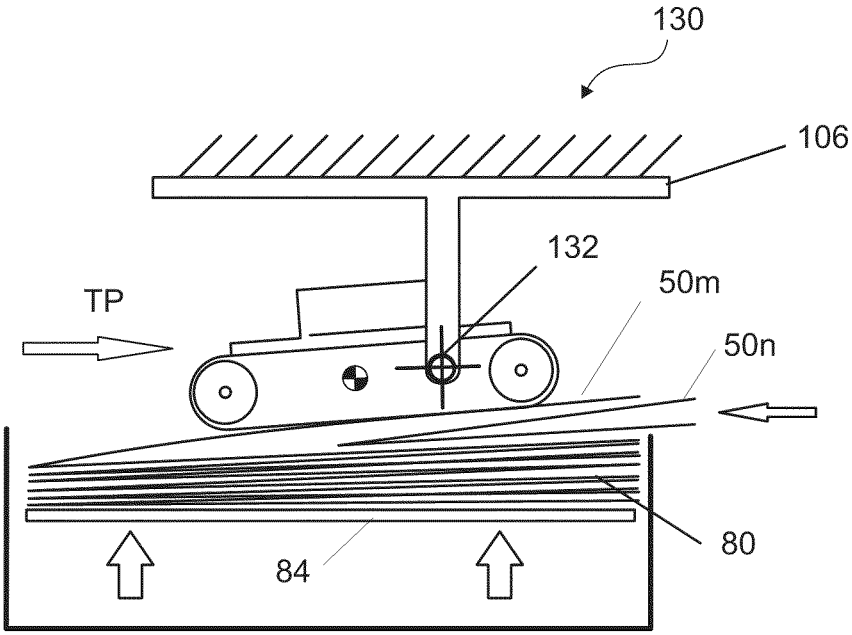
FIG. 15*b* shows the stack assembly of FIG. 15*a* with a second article being provided to the article being lifted.
Figure 15C:
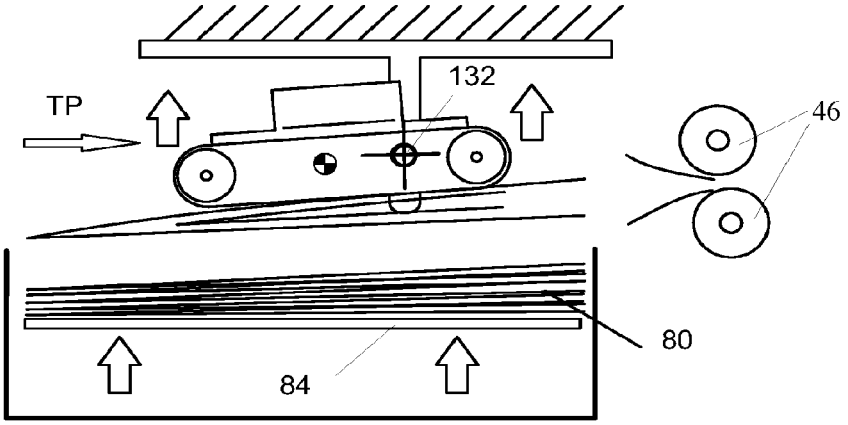
FIG. 15*c* shows the stack assembly of FIGS. 15*a* and 15*b* with the vortex suction unit having been moved upwards while the first and second articles are adhered.
Figure 15D:
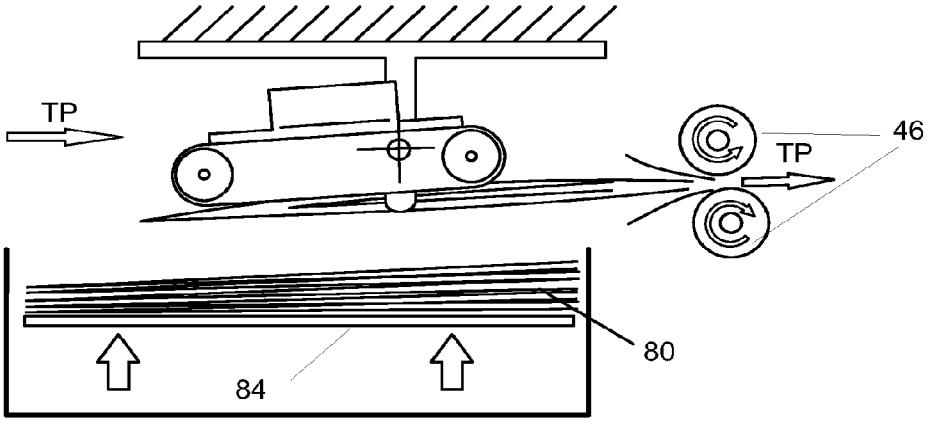
FIG. 15*d* shows the stack assembly of FIGS. 15*a-c* with the vortex suction unit conveying the first and second articles away from the stack.

As is illustratively shown in FIGS. 15*a-d*, a mounting assembly 130 which is adjustable to different angles α and distances b can be advantageously used to handle a wide array of articles 50. For example, the vortex suction unit 10 is first disposed at a distance b sufficient to lift the leading edge of the uppermost article 50, here an envelope 50*m*, and is rotated to an angle α that ensures a gradual separation (see FIG. 15*a*). As shown in FIG. 15*b*, the angle α also controls the degree of openness of the envelope 50*m* for a subsequent stuffing operation with a letter 50*n* (see FIG. 15*b*). Once the envelope 50*m* is stuffed, the vortex suction unit 10 can be moved away from the stack 80, for example, by moving the pivot 132 up the extension 133 (see FIG. 15*c*) so that the envelope 50*m* and letter 50*n* can be transferred along the transfer path TP for further processing (see FIG. 15*d*).

Figure 16:
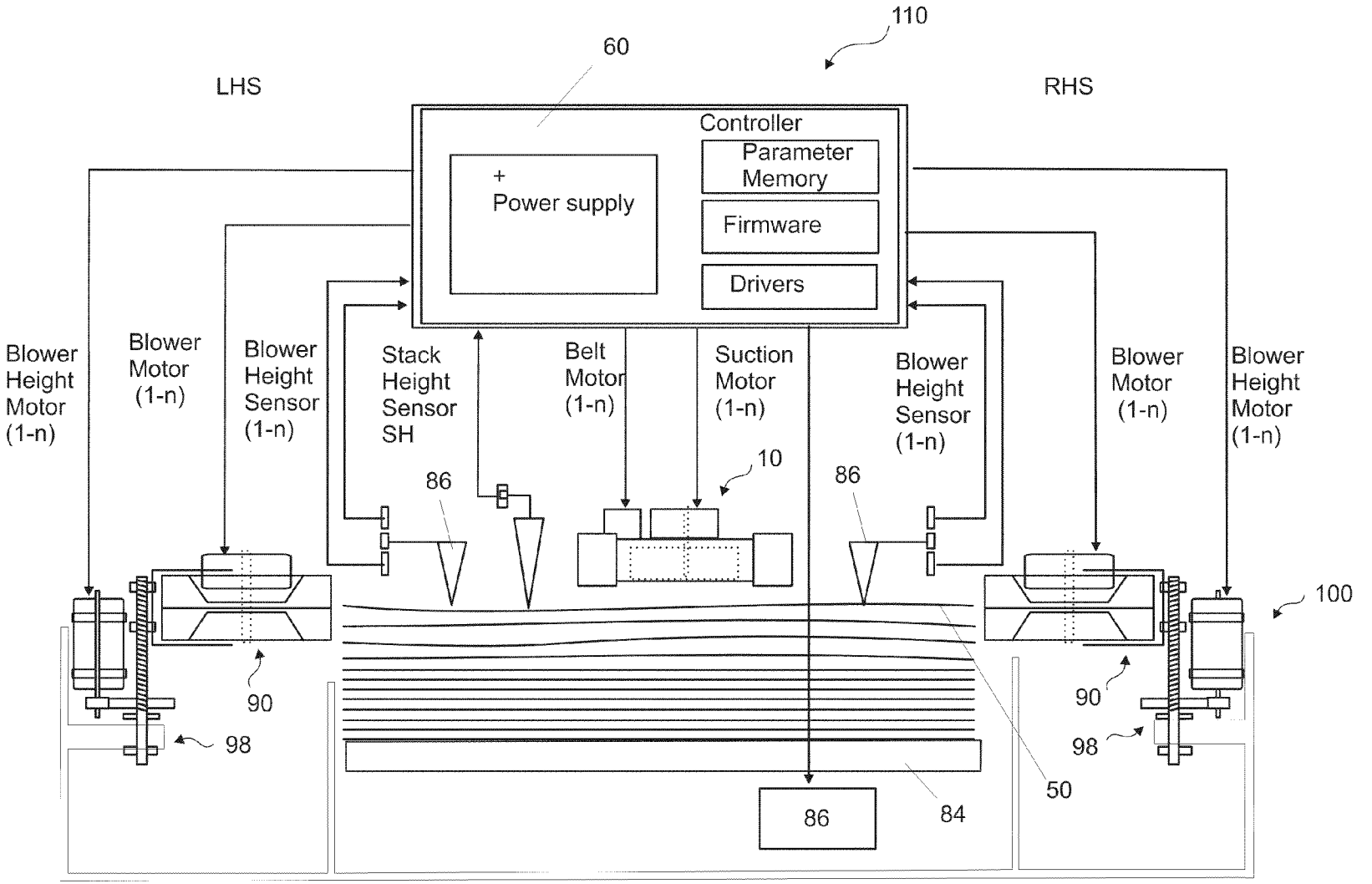
FIG. 16 is a schematic wiring diagram for a stack assembly according to an embodiment of the present invention.

Referring to FIG. 16, a control system 110 includes a main controller 60 for individually controlling the lift table motor 85, the height adjustment devices 98 of the side blowers 90 and one or more vortex suction units 10 either directly or through sub-controllers. The main controller 60, which can be, for example, controller Model No. AT90CAN128 manufactured by ATMEL Corp., receives feedback from the stack height sensors 86 to determine a relative location of the top of the stack 80, as well as a distance of the uppermost article 50 from the vortex suction unit 10. Based on the feedback from the stack height sensors 86, the vortex suction unit 10 is moved downward toward the stack 80 and/or the lift table 85 moves the stack upward toward the vortex suction unit 10 so that the vortex suction unit 10 is positioned at a predetermined distance b from the uppermost article 50 (see FIG. 9*b*). Alternatively, the vortex suction unit 10 could include a proximity sensor. The height of the side blowers 90 can also be adjusted from its position based on the feedback from the stack height sensors 86 and/or further height sensors can be provided to determine the height of the side blowers 90 individually.

The vortex suction units 10 can be continuously operated such that when the trailing edge 79 of an uppermost article 50 begins to pass by and uncover the orifice of the vortex suction unit 10, the subsequent article 50 begins to adhere and an uninterrupted separation and feeding along the transfer path TP is obtained. Alternatively, the speed or current consumption of the vortex suction unit 10 can be used to indicate that an article 50 is no longer covering the orifice and the vortex suction unit can be turned off, for example, in between articles 50 or stacks 80. Other means for determining whether an article is covering the orifice of the vortex suction unit 10 such as optical, mechanical or electrical sensors can also be used.

The articles 50 may be flat, flexible articles, such as paper or plastic sheets. However, other types of flat articles, such as boxes or containers of various shapes may be carried by conveyance systems 100 using vortex suction units 10 according to the present invention.

While the invention has been particularly shown and described with reference to preferred embodiments thereof, it will be understood by those skilled in the art that various changes in form and details may be made therein without departing from the spirit and scope of the invention. Accordingly, the invention is to be limited only by the scope of the claims and their equivalents.

What is claimed is:

1. A system for separating a flat, flexible article from an outer part of a stack and conveying it along a transfer path, the system comprising:

a stack assembly configured to receive a stack of flat, flexible articles; and a mounting assembly including at least one vortex suction unit disposable so as to face the stack of articles at at least one of a leading edge and a trailing edge thereof and configured to attract the flat, flexible article from the stack, the at least one vortex suction unit including a conveyor configured to transport the flat, flexible article along the transfer path.

2. The system according to claim 1, wherein the stack assembly includes at least one adhesion reduction device disposed adjacent to an outer article of the stack.

3. The system according to claim 2, wherein the adhesion reduction device includes an aerating device configured to vary a position of the articles relative to each other.

4. The system according to claim 3, wherein the aerating device includes at least one side blower having a radial fan that is adjustable in height relative to the stack so as to aerate a portion of the stack.

5. The system according to claim 1, wherein at least one of a distance and an angle of an impeller of the at least vortex suction unit is adjustable relative to an outer article of the stack.

6. The system according to claim 1, wherein the at least one vortex suction unit is disposed above or below the stack at a distance of between 0 and 60 mm.

7. The system according to claim 1, wherein the stack assembly includes at least one stack height sensor disposed above an outer article of the stack.

8. The system according to claim 1, wherein the distance of the at least one vortex suction unit to the uppermost article of the stack is adjustable between 0 and 60 mm.

9. The system according to claim 1, wherein an angle of an impeller axis to an outer article of the stack is adjustable between −45° to 45°.

10. The system according to claim 9, wherein the vortex suction unit is disposable at the leading edge of the stack and the angle of the impeller axis of the at least one vortex suction unit relative to the outer article of the stack is adjustable between 0° to 45°.

11. The system according to claim 1, wherein the conveyor includes at least one belt extending in a direction of the transfer path and configured to receive the article thereagainst under an attraction force of the at least one vortex suction unit.

12. The system according to claim 1, wherein the conveyor includes at least one belt configured to transport the article in a direction substantially orthogonal to an impeller axis of the vortex suction unit.

13. The system according to claim 1, wherein an angle of a contact surface of the conveyor to an outer article of the stack is adjustable between −45° to 45°.

14. A method of separating an flat, flexible article from an outer part of a stack of flat, flexible articles comprising:

disposing at least one vortex suction unit at a distance opposite an edge of the stack of flat, flexible articles; and attracting the flat, flexible article from the stack and conveying it along a transfer path using the at least one vortex suction unit.

15. The method according to claim 14, further comprising adjusting at least one of the distance and an angle of an impeller axis of the at least one vortex suction unit relative to the stack.

16. The method according to claim 15, wherein the angle is adjusted to between −45° to 45°.

17. The method according to claim 14, wherein the edge of the stack is a leading edge of the stack in a direction of the transfer path of the article.

18. The method according to claim 17, wherein the at least one vortex suction unit includes a plurality of vortex suction units that are individually operated.

19. The method according to claim 14, wherein the conveying includes transporting the article away from the stack while the article is adhered by the at least one vortex suction unit.

20. The method according to claim 14, further comprising reducing adhesion between the articles.

21. The method according to claim 20, wherein the reducing adhesion includes at least one of aerating and vibrating the articles.

22. The method according to claim 14, wherein the disposing is performed such that the distance is between 0 and 60 mm.

23. The method according to claim 14, wherein the conveying is performed using a conveyor belt configured to receive the article thereagainst at a contact surface thereof under an attraction force of the at least one vortex suction unit.

24. The method according to claim 23, further comprising varying an angle of the contact surface relative to the stack.

25. The method according to claim 14, wherein the conveying is performed using a conveyor belt so as to convey the article in a direction substantially orthogonal to an impeller axis of the vortex suction unit.

26. The method according to claim 14, wherein the edge of the stack is at a top or a bottom of the stack.

* * * * *